US011920471B2

(12) United States Patent
Halkyard et al.

(10) Patent No.: US 11,920,471 B2
(45) Date of Patent: Mar. 5, 2024

(54) METHODS FOR REDUCING SEDIMENT PLUME IN DEEPSEA NODULE MINING

(71) Applicant: Deep Reach Technology, Inc., Houston, TX (US)

(72) Inventors: John Halkyard, Houston, TX (US); Michael Rai Anderson, Sugar Land, TX (US); James Wodehouse, Llano, NM (US)

(73) Assignee: Deep Reach Technoloy, Inc., Houston, TX (US)

( * ) Notice: Subject to any disclaimer, the term of this patent is extended or adjusted under 35 U.S.C. 154(b) by 182 days.

(21) Appl. No.: 17/432,710

(22) PCT Filed: Feb. 20, 2020

(86) PCT No.: PCT/US2020/019075
§ 371 (c)(1),
(2) Date: Aug. 20, 2021

(87) PCT Pub. No.: WO2020/172434
PCT Pub. Date: Aug. 27, 2020

(65) Prior Publication Data

US 2022/0178108 A1 Jun. 9, 2022

Related U.S. Application Data

(60) Provisional application No. 62/824,075, filed on Mar. 26, 2019, provisional application No. 62/808,198, filed on Feb. 20, 2019.

(51) Int. Cl.
*E21C 50/00* (2006.01)
*E02F 3/94* (2006.01)

(52) U.S. Cl.
CPC ..... *E21C 50/00* (2013.01); *E02F 3/94* (2013.01)

(58) Field of Classification Search
CPC ..... E02F 3/94; E21C 50/00
See application file for complete search history.

(56) References Cited

U.S. PATENT DOCUMENTS 3,433,531 A * 3/1969 Koot ..... E02F 3/8858 299/8
3,672,725 A * 6/1972 Johnson ..... E02F 3/907 299/8
3,802,740 A * 4/1974 Sullivan ..... E02F 3/9243 299/8
3,971,593 A 7/1976 Porte et al.
3,972,566 A 8/1976 Brockett, III et al.
(Continued)

FOREIGN PATENT DOCUMENTS

CN 107075395 A 8/2017
JP 5891290 B 10/1988
WO 2012171075 A1 12/2012

OTHER PUBLICATIONS

Notification of international search report and written opinion of the international searching authority based on PCT/PCT/US20/19075, dated Jun. 22, 2020, 10 pages.
(Continued)

*Primary Examiner* — Janine M Kreck

(57) ABSTRACT

A method and apparatus for generating a slurry from the surface of the subsea floor, separating that slurry into multiple slurries, and pumping the desired slurry to the surface.

7 Claims, 6 Drawing Sheets

(56) References Cited

U.S. PATENT DOCUMENTS

| | | | | |
|---|---|---|---|---|
| 4,042,279 | A | 8/1977 | Asakawa | |
| 4,070,061 | A * | 1/1978 | Obolensky | E02F 3/92 299/8 |
| 4,232,903 | A | 11/1980 | Welling et al. | |
| 4,368,923 | A * | 1/1983 | Handa | E02F 3/9218 299/8 |
| 4,398,361 | A | 8/1983 | Amann et al. | |
| 8,678,514 | B2 * | 3/2014 | Efthymiou | E02F 3/8866 299/8 |
| 2009/0284068 | A1 | 11/2009 | Yu et al. | |
| 2018/0266074 | A1 | 9/2018 | Halkyard et al. | |
| 2018/0291588 | A1 | 10/2018 | Subrahmanyam | |

OTHER PUBLICATIONS

"Polymetallic Nodules Resource Classification", Report of an international workshop hosted by the Ministry of Earth Sciences, Government of India and the International Seabed Authority, Goa, India, Oct. 13-17, 2014, 79 pages.

ISA—International Seabed Authority (1999), "Proposed Technologies for Deep Seabed Mining of Polymetallic Nodules", Proceedings of the ISA's Workshop held in Kingston, Jamaica, Aug. 3-6, 1999, 464 pages.

ISA—International Seabed Authority (2008), "Polymetallic Nodule Mining Technology: Current Status and Challenges Ahead", Proceedings of a workshop held by the ISA in Chennai, India, Feb. 18-22, 2008, 284 pages.

Kaufman, R., Latimer, J. P., D. C. Tolefson and S. Senni (1985), "The Design and Operation of a Pacific Ocean Deep-Ocean Mining Test Ship: R/V Deepsea Miner II" Offshore Technology Conference, Paper OTC 4901, Houston, Texas USA, 20 pages.

Miller, Kathryn A., Thompson, Kirsten F., Johnson, Paul and David Santillo (2018) "An Overview of Seabed Mining Including the Current State of Development, Environmental Impacts, and Knowledge Gaps", Frontiers in Marine Science, Review, Jan. 10, 24 pages.

McCormack, Gerald (2016), "Cook Islands Seabed Minerals—a precautionary approach to mining", Cook Islands Heritage Trust, 24 pages.

Popular Mechanics 1977 OMI Tests, Nov. 1978, 7 pages.

Shaw, John L. (1993), "Nodule Mining—Three Miles Deep", Marine Geosciences and Geotechnology, vol. 11, pp. 181-197, 17 pages.

Supplementary European Search Report dated Mar. 17, 2022.

* cited by examiner

METHODS FOR REDUCING SEDIMENT PLUME IN DEEPSEA NODULE MINING

RELATED APPLICATIONS

This application is a 371 U.S. National phase application of PCT/US20/19075 filed Feb. 20, 2020, which claims priority to U.S. Provisional Application No. 62/824,075, filed Mar. 26, 2019 and U.S. Provisional Application No. 62/808,198, filed Feb. 20, 2019.

This invention was made with government support under contract DE-AR0001234 awarded by ARPA-E, the Advanced Research Projects Agency-Energy. The government has certain rights in the invention.

BACKGROUND

Nodule mining has been tested on a pilot scale but there has not been any commercial mining. Successful pilot tests have been performed using a towed collector (dredge head) which collects nodules hydraulically and passes them as a slurry to a riser to carry the nodule slurry to the surface. Lifting may be accomplished by submerged mechanical pumps, or by injecting compressed air into the riser creating a low density in the flow above the injection point and consequent suction below that point. This latter method is called the "airlift".

The collector consists of a suction head through which water is pumped to entrain the nodules, and duct work to pass the nodules to the riser. In order to attain high efficiency for a range of operating conditions the suction head must move a large volume of water through its nozzle, creating a relatively low concentration of nodules (1-3% by volume). In the process it also collects a similar concentration of seafloor sediment.

For the concentrator 14 shown in FIG. 1, the nodules recovered from the seabed 10 as a slurry with water and sediment by the collector head 11 pass through duct 12 and diffuser 13 to enter the hopper 15. Nodule larger than a certain size, and a portion of the water and sediment, fall to the bottom of the hopper 15 and are entrained in the riser flow 19. Excess water, sediment and smaller nodules from the suction 12 exits out the concentrator overflow 16. Because the sediment consists of fine, clay size, or smaller particles, most of the sediment is removed with this overflow 16. The overflow water and sediment create a cloud, or plume, which disperses and settles on the seabed. About 90% of the water and sediment collected by the suction head makes up this plume which is discharged within a few meters of the seabed 10. The collector head 11 typically creates a cut depth 20 of about 10-16 cm into the seabed strata 18.

The remainder of the water and sediment from the suction head, along with most of the nodules are pumped to the surface and a production vessel. The production vessel has a means for separating most of the water and sediment from the slurry before the nodules are shipped to shore on shuttle ore carriers. The excess water and sediment are discharged through a separate conduit to a suitable depth for disposal.

The discharge from the surface and the bottom effluent both create plumes of sediment and water which are of potential environmental concern. These plumes are disbursed by currents and settle over an area of the seabed and may affect the fauna, which becomes buried. This presents a motivation and desire to reduce the amount of sediment in these plumes, especially the surface discharge plume as it may be discharged at some distance above the seabed and disburse over a larger area.

SUMMARY OF EXAMPLE EMBODIMENTS

An example embodiment may include an apparatus for generating a slurry having a first pump with an inlet and an outlet, wherein the inlet is exposed to the outside environment, a first pipe connecting the first pump to a pickup nozzle, wherein the pickup nozzle is adapted to remove material from the surface, a second pipe connecting the pickup nozzle a diffuser, to reduce slurry velocity to an inlet of a separator, the separator having a fine screen, a fine screen output, a second pump with an inlet coupled to the fine screen output and an output coupled to the input of a electrocoagulator, and a third pump with an inlet exposed to the outside environment and an output for sending a slurry to a subsea pipe.

An example embodiment may include an apparatus for recovering seafloor minerals including a collecting apparatus for recovering nodules, sediment and water from the seabed using a hydraulic pickup head, a pipe connecting a pickup head to a diffuser and an inlet of a gravity separator, the gravity separator having a fine screen, a fine screen output, a first pump with an inlet coupled to the fine screen output and an output coupled to a diffuser and discharge pipe leading to the surrounding environment, a second pump with an inlet and an outlet, and in which the inlet is exposed to the outside environment and an outlet which is connected to the bottom of the separator and to a subsea pipe.

A variation of the example embodiment may include an electrocoagulator attached to the diffuser connected to the outlet of the first pump and the outlet of the electrocoagulator coupled to a discharge pipe leading to the surrounding environment. It may include a third pump with an inlet coupled to bottom of the separator and the outlet of the second pump, and an outlet of the third pump for sending a slurry to a subsea pipe. It may include an electrocoagulator attached to the diffuser connected to the outlet of the first pump and the outlet of the electrocoagulator coupled to a discharge pipe leading to the surrounding environment. It may include the gravity separator having a coarse screen and a first coarse screen output for particles greater than a predetermined size and a second coarse screen output for particles less than the predetermined size.

An example embodiment may include an apparatus for recovering seafloor minerals including a collecting apparatus for recovering nodules, sediment and water from the seabed using a hydraulic pickup head, a pipe connecting a pickup head to a diffuser and an inlet of a gravity separator, the separator having a fine screen, a fine screen output, and the fine screen output coupled to a diffuser and an electrocoagulator and the outlet of the electrocoagulator coupled to a discharge pipe leading to the surrounding environment.

A variation of the example embodiment may include a first pump with an inlet and an outlet, wherein the inlet is exposed to the outside environment and an outlet which is connected to the bottom of the separator and to a subsea pipe. It may include the gravity separator having a coarse screen and a first coarse screen output for particles greater than a predetermined size and a second coarse screen output for particles less than the predetermined size.

An example embodiment may include an apparatus for recovering seafloor minerals including a collecting apparatus for recovering nodules, sediment and water from the seabed using a hydraulic pickup head, and a pipe connecting a pickup head to a diffuser and an inlet of a gravity separator, the separator having an opening at or near the top of the separator allowing water and fine particles to flow through the opening into a pipe outlet and to an electrocoagulator and the outlet of the electrocoagulator coupled to a discharge pipe leading to the surrounding environment. A variation of the example embodiment may include a first pump with an inlet and an outlet, wherein the inlet is exposed to the outside environment and an outlet which is connected to the bottom of the separator and to a subsea pipe. It may include the gravity separator having a coarse screen and a first coarse screen output for particles greater than a predetermined size and a second coarse screen output for particles less than the predetermined size.

An example embodiment may include a method for mining the subsea floor including generating a first slurry by removing a surface layer of the subsea floor and mixing it with water, flowing the first slurry into a separator, flowing the first slurry through a fine particle screen to form a second slurry, collecting particles from the first slurry, that do not pass through the fine particle screen, at the bottom of the separator and allowing them to enter a stream of water from the surrounding environment to create a third slurry that is passed to a subsea pipe for pumping to the surface.

A variation of the example embodiment may include pumping the second slurry into the ocean proximate to the subsea floor. It may include pumping the second slurry through an electrocoagulation device creating a fourth slurry to be discharged into the ocean proximate to the subsea floor. The first slurry may be a plurality of first slurries. The second slurry may be a plurality of second slurries. The third slurry may be a plurality of third slurries. The separator may be a plurality of separators.

An example embodiment may include a method for mining the subsea floor including generating a first slurry by removing a surface layer of the subsea floor and mixing it with water, flowing the first slurry into a separator, flowing a portion of the first slurry through an opening and duct to form a second slurry, flowing the second slurry through an electrocoagulation device creating a third slurry to be discharged into the ocean proximate to the subsea floor, collecting particles from the first slurry, that do not pass through the fine particle screen, at the bottom of the separator and allowing them to enter a stream of water from the surrounding environment to create a third slurry that is passed to a subsea pipe for pumping to the surface. A variation of the example embodiment may include pumping ocean water into the first slurry.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLE EMBODIMENTS

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

The disclosed example embodiments minimize the amount of sediment that enters a lift system for conveyance to a surface production vessel from a seafloor mining system that is recovering an ore such as polymetallic nodules by hydraulic means. Such a collection system causes seafloor sediment and the ore to be collected simultaneously and it is advantageous to remove all the sediment at the seafloor to avoid the need to subsequently discharge it with wastewater from the shipboard dewatering operation. The disclosed example embodiments mitigate the impact or range of influence of sediment that is discharged at the seafloor. The disclosed example embodiments allow control of the concentration of ore entering the lift system to obtain optimum conditions for pumping the ore slurry to the surface.

Figure 2:
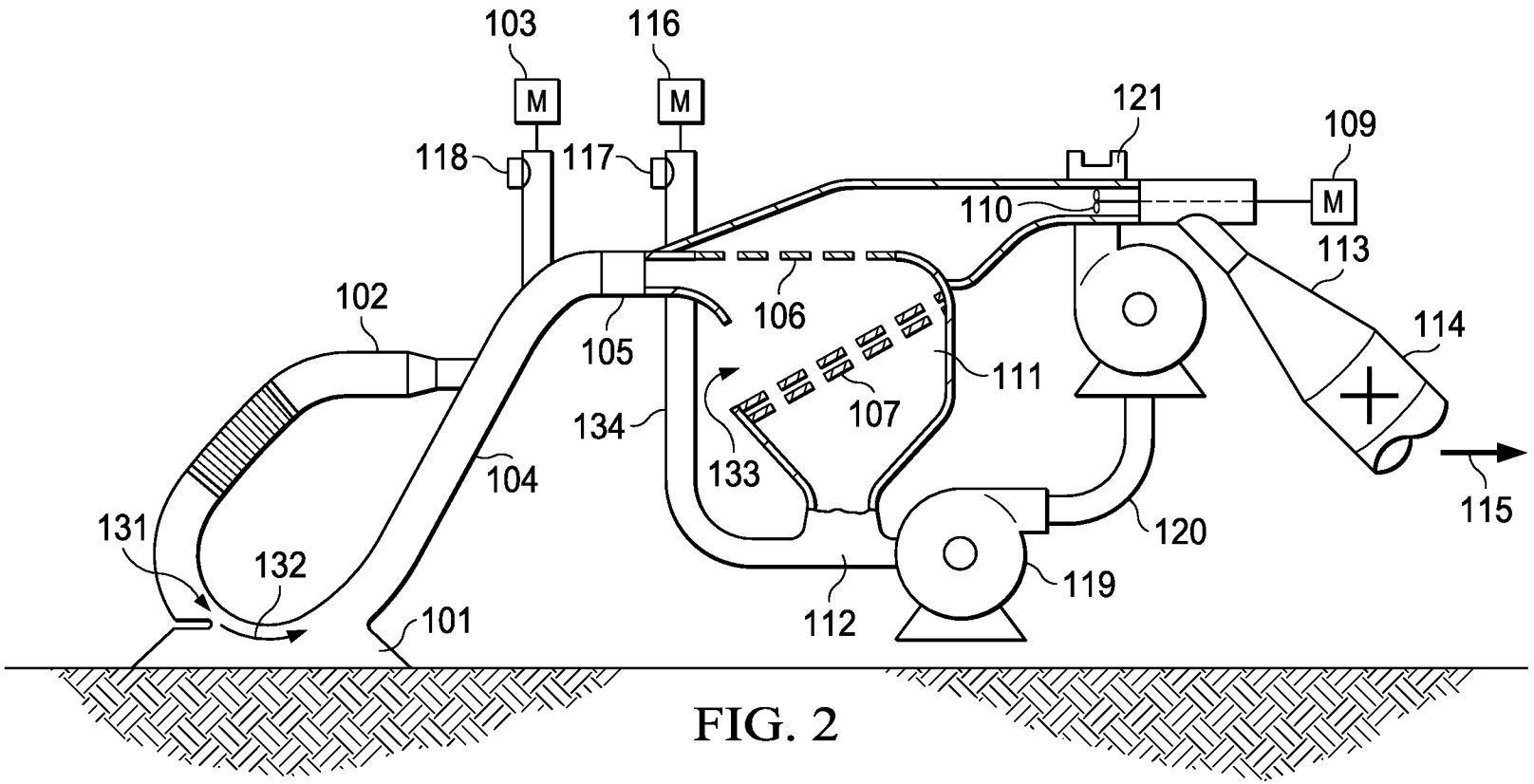
FIG. 2 is an example cutaway view of an example embodiment.

An example embodiment disclosed in FIG. 2 shows a cross section of ducting. In this example embodiment, nodules, sediment and water are entrained by passing a jet of water 132 through the collector head 101. This jet is produced by pumping seawater entering inlet 118, through a pump driven by a motor 103 through ducting 102 to the jet nozzle 131. The jet nozzle 131 is configured to cause the water flow to follow the contour of the collector head 101 by the principle of Coanda flow. The flow entrains additional seawater, nodules and sediment which passes through the ducting 104. The flow may be boosted by an additional pump (not shown) in ducting 104 to increase the pressure in the flow. The flow of nodules, seawater and sediment passes through a diffuser 105 to reduce flow velocities, turbulence and dynamic head. The flow enters a separator/hopper 111 which separates the sediment and seawater from the collected nodules. Separation is achieved by inducing flow through a screen 106 with a pump 110 driven by a motor 109. Screen 106 may be sized to only allow particles of less than 5 cm in diameter to pass. Nodules and a portion of the collected water and sediment fall to the bottom of the hopper 111 to form a concentrated mixture (slurry) 112 to enter the lift system. The pump 110 driven by motor 109 is controlled to force most of the collected water and sediment passing through duct 104 to pass through the screen 106. Screen 106 would preferably be a non-clogging type of screen. Larger particles fall by gravity through a coarse screen 107 into the bottom of the hopper where they are entrained in flow from duct 134 and pumped to a riser pipe 121 by pump 119 through duct 120. The coarse screen 107 may be designed to remove particles larger than 15 cm in diameter that could block the riser pipe 121, the removed particles are discharged to the seabed through opening 133. In this example embodiment the concentrated mixture slurry 112 may include particles between 6 cm and 15 cm in diameter. A person skilled in the art will recognize that the range of particle size to be screened can be adjusted up and down for both the fine screen 106 and the coarse screen 107, based on the range of minerals desired for recovery.

Particles larger than a predetermined size are collected on screen 107 and discharged through opening 133.

The flow through duct 134 is generated by pump and motor 116, drawing in water via inlet 117, which is controlled to achieve the optimum concentration of solids delivered to the lift system through pump 119 and duct 120.

The sediment, water, and smaller particles that are pumped through screen 106 pass through pump 110 and enter diffuser 113 to reduce the flow velocity and turbulence in the flow. In this embodiment, the flow from the diffuser 113 is passed through an electrocoagulator 114 which causes the sediment particles to self-flocculate and settle more quickly to the seabed when discharged as a slurry 115 behind the collector. The electrocoagulator, also known as an elelctrocatalytic oxidation (EOX) treatment system, works on the principle of electrokinetics. A high current electrical field is applied to the water-sediment slurry via electrodes. The electrical field destabilizes the molecular bonds between the sediment and the water. Through the destabilization process, the sediment particles coagulate and separate from the water by settling. Electrocoagulation is an established technology in the wastewater industry.

Another example embodiment (not shown) would exclude the electrocoagulator 114. The flow of sediment and water through pump 110 and diffuser 113 would be deposited close to the seafloor at a discharge velocity close to the forward velocity of the collector for the discharged solids to settle in the wake of the collector.

Figure 3:
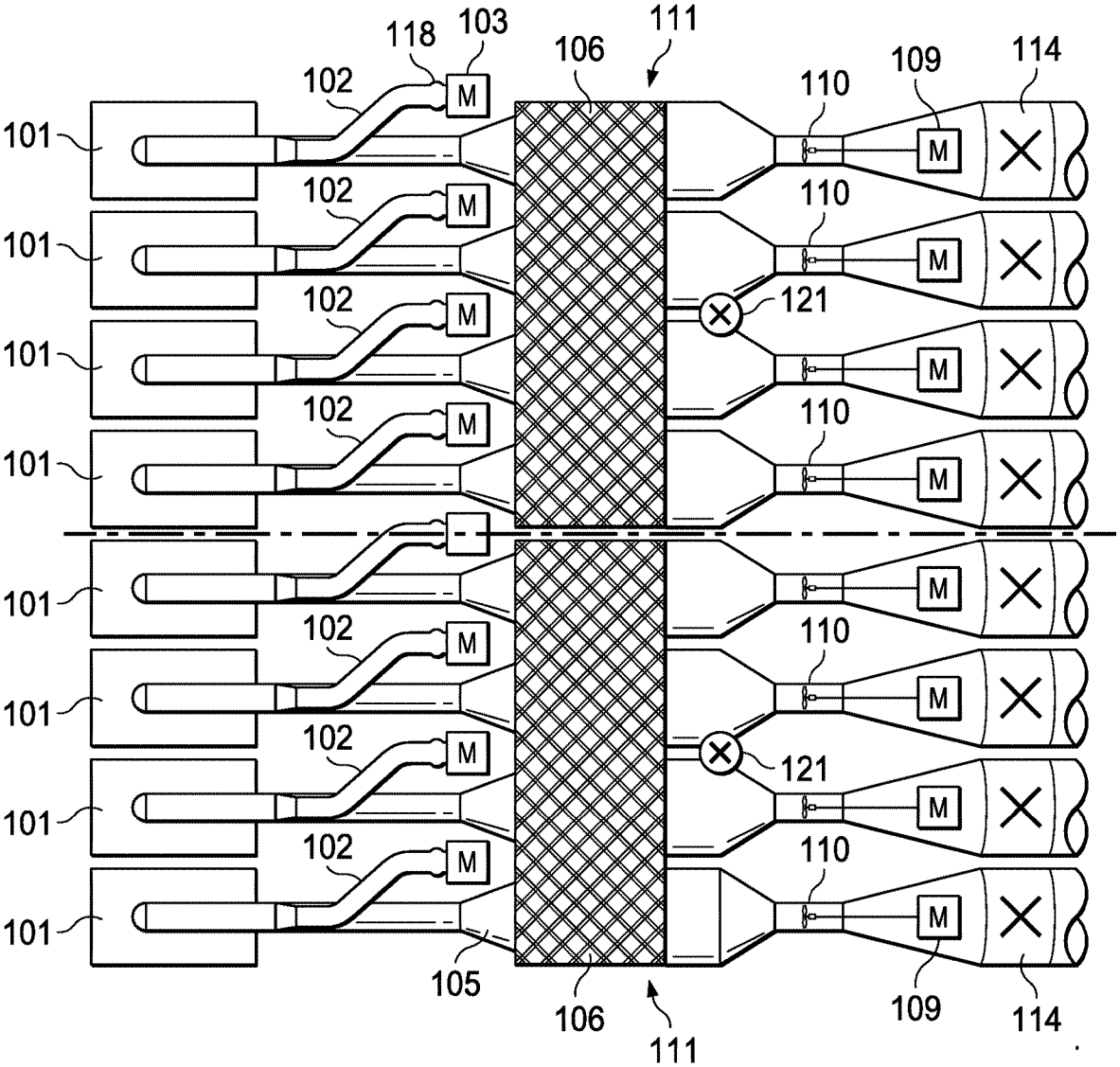
FIG. 3 is a top view of a nodule collector with multiple collector head embodiments.
Figure 4:
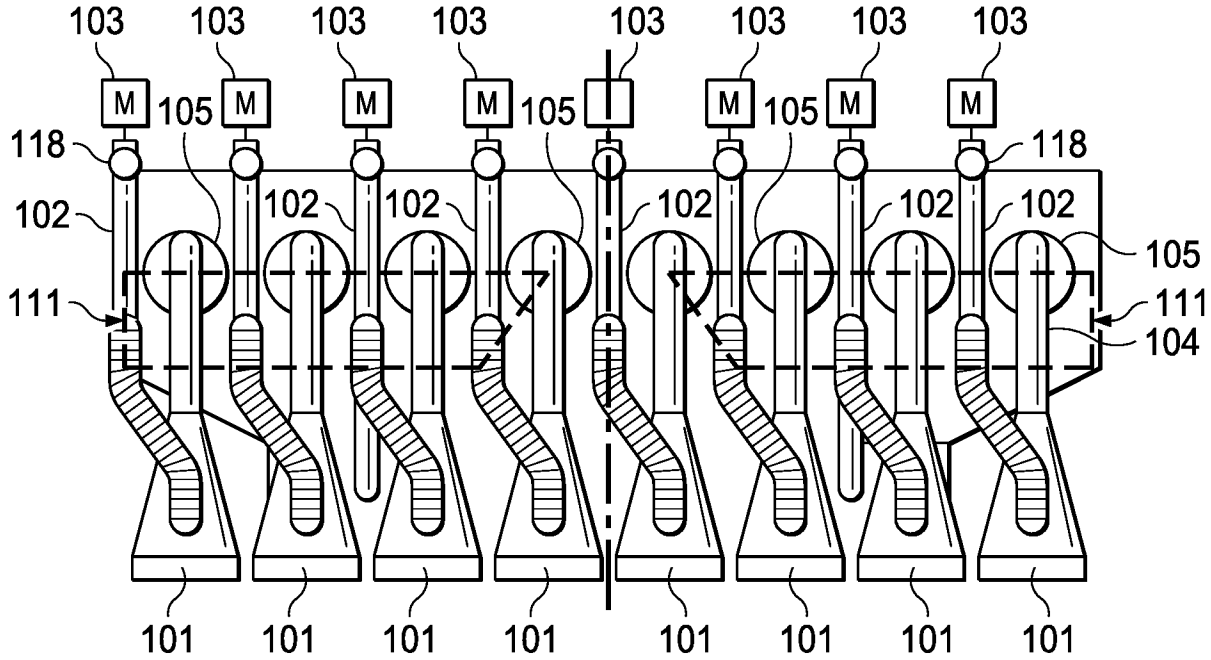
FIG. 4 is a front view of a nodule collector with multiple collector head embodiments of the collector

The profile in FIG. 2 is an internal cutaway view of one collector head and associated ducting. An example embodiment, for larger rates required for commercial production, would have a number of collector heads arranged as shown in FIGS. 3 and 4. Each collector head 101 would be approximately 1.5 m. wide. Inlets 118 bring in water via pumps driven by motors 103 into ducting 102. The embodiments shown in FIGS. 3 and 4 have eight collector heads 101, eight diffusers 105, and two hoppers 111, each of which are designed to process the flow from four collector heads using screens 106. This embodiment has eight discharge pumps 110 and motors 109 aligned with the eight collector heads and ducting sending discharge sediment to electrocoagulators 114. Riser pipes 121 send the desired nodule slurry to the surface. Different combinations of collector heads, hoppers and discharge ducting may also be used in these example embodiments.

Figure 5:
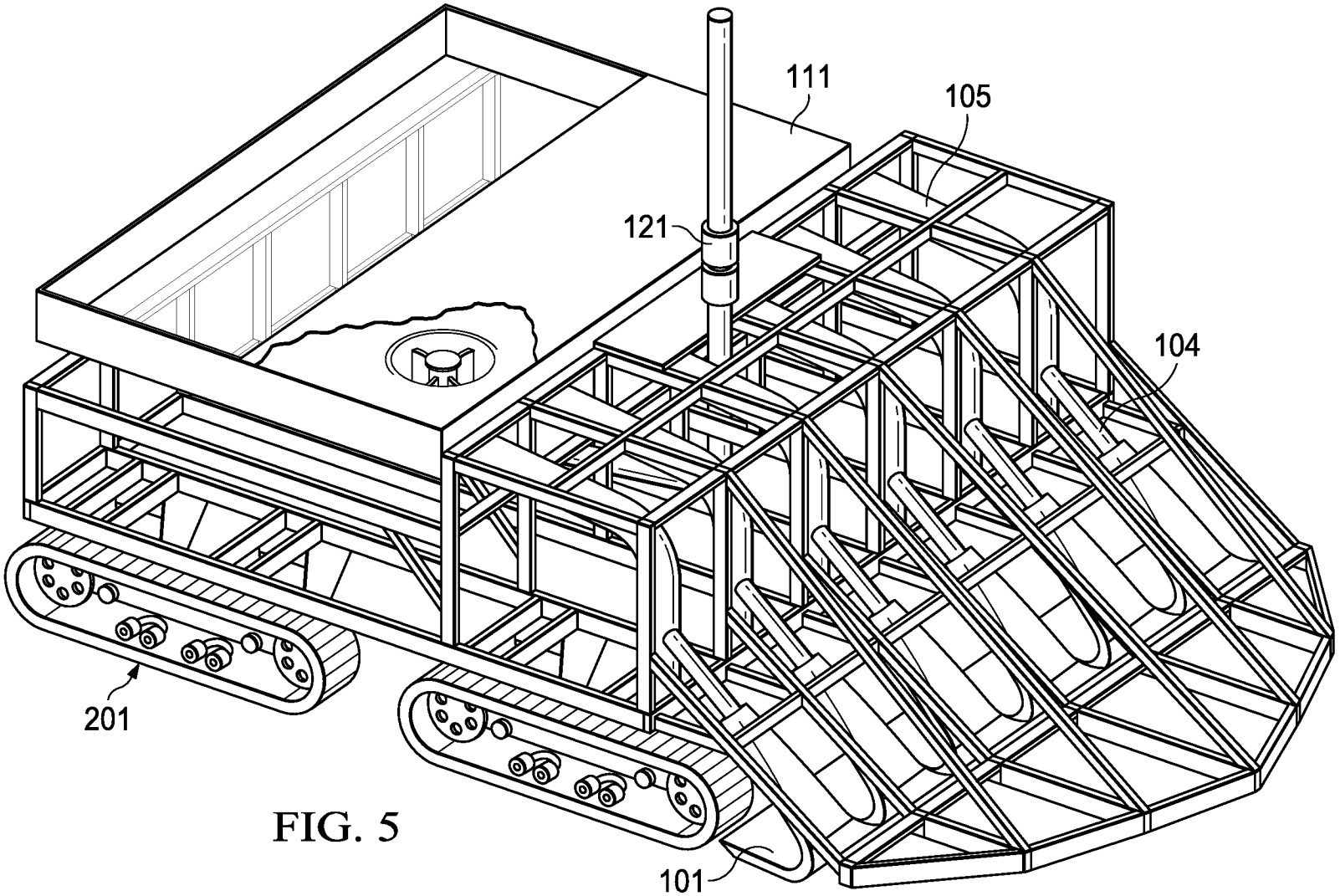
FIG. 5 is a three-dimensional rendering of a nodule collector with the above embodiments integrated with a sub-structure and tracks for mobility on the seafloor.

FIG. 5 shows an example rendering of an example embodiment with supporting structure to function as a complete seafloor collecting vehicle. This embodiment is propelled along the seafloor by tracks 201. Another embodiment would be supported on skids and would be towed across the seafloor along said skids. FIG. 5 illustrates an embodiment of the collector which incorporates a pump (not shown) in ducting 104 to create suction at the collector head 101. This in contrast to the Coanda nozzle using jet entrainment as illustrated in FIGS. 2-4. FIG. 5 shows flow from ducting 104 flowing through diffusers 105 directly into gravity settling tank 111. Riser pipe 121 sends the desired nodule slurry to the surface.

Figure 6:
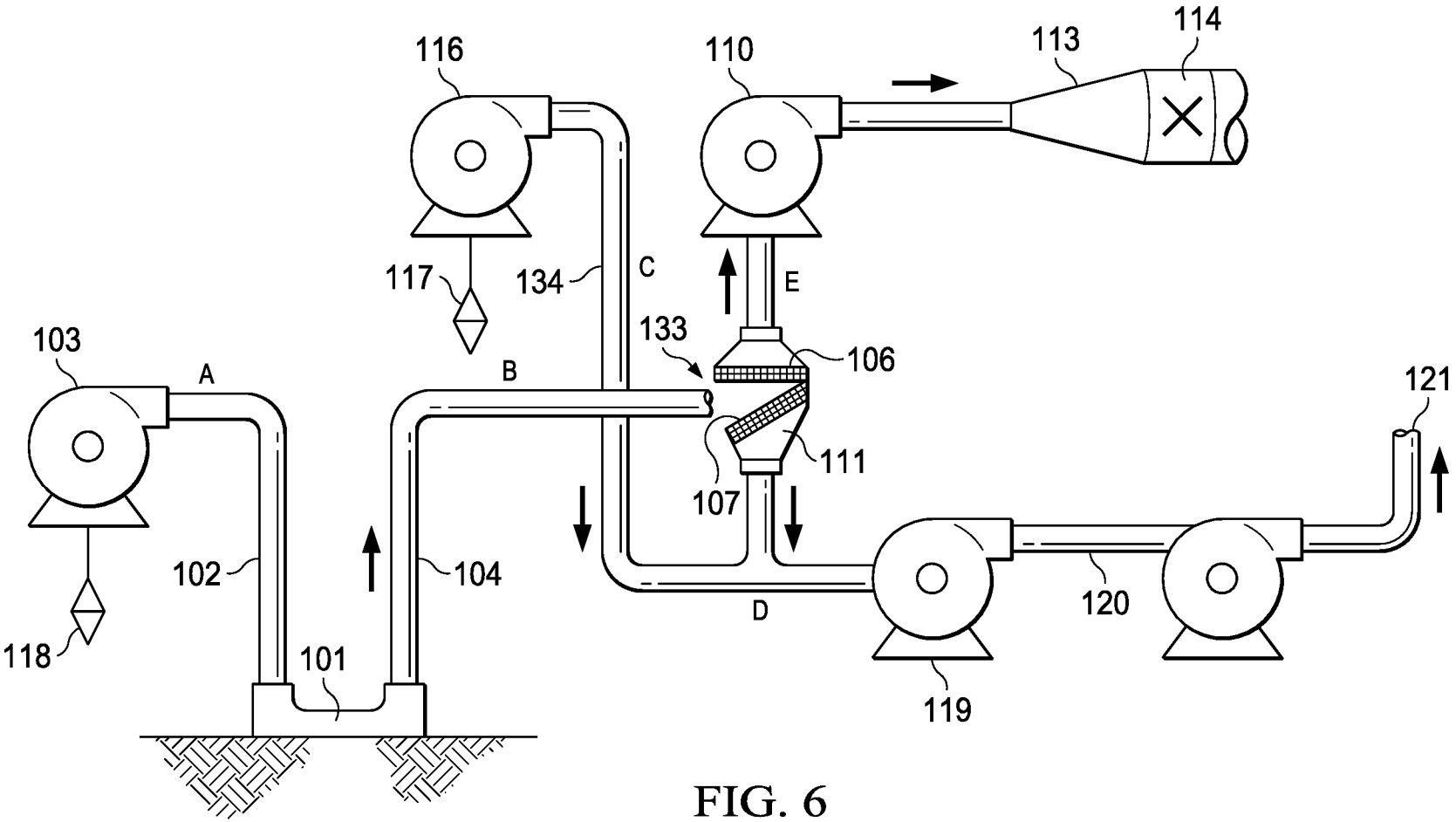
FIG. 6 is an example schematic of an example embodiment.

FIG. 6 shows an illustrative schematic of an example embodiment shown in FIG. 2 with accompanying Table 1 which illustrates the material flows in the proposed embodiment. Inlet flows, sediment and nodule concentrations shown in Table 1 are typical of values measured in previous deep-sea pilot mining tests. The flows shown in Table 1 are representative of the embodiments illustrated in FIGS. 2-4. Specifically, the flows are indicative of the flows in each component of a commercial collector of which there are eight (8) collector heads 101 and associated ducting 102 and 104 (Flows A & B), two (2) riser primer pumps 116 and ducts 134 (Flow C), one (1) riser 121 (Flow D) and eight (8) electrocoagulator circuits 110 (Flow E).

TABLE 1

| | Flow rates | | | | |
|---|---|---|---|---|---|
| | A (8) | B (8) | C (2) | D (1) | E (8) |
| Wt Flow (tph) | | | | | |
| Nodules | 0.0 | 38.6 | 0.0 | 293.6 | 1.9 |
| Sediment | 0.0 | 27.0 | 0.0 | 0.0 | 27.0 |
| Water | 450.1 | 900.2 | 293.9 | 587.7 | 900.2 |
| Total | 450.1 | 965.8 | 293.9 | 881.3 | 929.1 |
| Vol Flow (m3/hr) | | | | | |
| Nodules | 0.0 | 20.3 | 0.0 | 154.5 | 1.0 |
| Sediment | 0.0 | 10.2 | 0.0 | 0.0 | 10.2 |
| Water | 439.1 | 878.2 | 286.7 | 573.4 | 878.2 |
| Total | 439.1 | 908.7 | 286.7 | 727.9 | 889.4 |
| Density (kg/m3) | 1,025.0 | 1,062.8 | 1,025.0 | 1,210.8 | 1,044.6 |
| Wt % solids | 0.0% | 6.8% | 0.0% | 33.3% | 3.1% |
| Vol % solids | 0.0% | 3.4% | 0.0% | 21.2% | 1.3% |
| Pump Head, m | 2 | | 2 | 100 | 4 |
| Power/Pump, kw | 11 | | 7 | 920 | 45 |
| Power Total, kw | 89 | | 14 | 920 | 45 |

Figure 1:
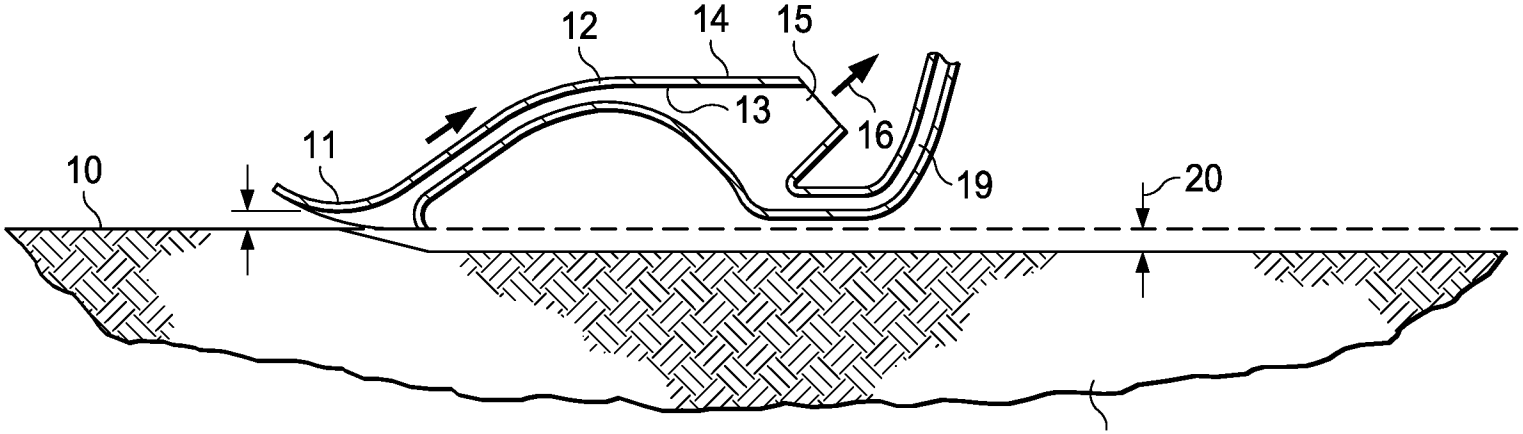
FIG. 1 is an example of the prior art.

Although the invention has been described in terms of embodiments which are set forth in detail, it should be understood that this is by illustration only and that the invention is not necessarily limited thereto. In particular, although the embodiments described above incorporate a screen 106 and pump 110 for removing water and fine particles from the flow through 104, and an electrocoagulator 114 for creating a slurry that will settle more quickly, the invention could incorporate the electrocoagulator 114 without the pump 110 and/or the screen 106. In this case the flow through the diffuser 113 and electroocoagulator 114 would be less than 100% of the water and fine sediment in the slurry passing through ducting 104, but it would still be an improvement over prior art depicted on FIG. 1. In this case the need for pump 116 and inlet 117 might also be eliminated and the flow to the seabed pipe 120 could be from flow passing through the separator as is the case in the prior art.

Similarly, an embodiment including the screen 106 and pump 110, but excluding the electorcoagulator 114 would also be covered by this invention. Accordingly, modifications of the invention are contemplated which may be made without departing from the spirit of the claimed invention.

What is claimed is:

1. A method for mining the subsea floor comprising:

generating a first slurry by removing a surface layer of the subsea floor and mixing it with water;

flowing the first slurry into a separator;

flowing the first slurry through an opening at or near the top of the separator to form a second slurry; and collecting particles from the first slurry, that do not pass through the opening, at the bottom of the separator and allowing them to enter a stream of water from the surrounding environment to create a third slurry that is passed to a subsea pipe for pumping to the surface;

pumping the second slurry through an electrocoagulation device creating a fourth slurry to be discharged into the ocean proximate to the subsea floor.

2. The method for mining the subsea floor of claim 1, further comprising a fine screen at the opening and pumping the second slurry into the ocean proximate to the subsea floor.

3. The method for mining the subsea floor of claim 1, wherein the first slurry is a plurality of first slurries.

4. The method for mining the subsea floor of claim 1, wherein the second slurry is a plurality of second slurries.

5. The method for mining the subsea floor of claim 1, wherein the third slurry is a plurality of third slurries.

6. The method for mining the subsea floor of claim 1, wherein the separator is a plurality of separators.

7. A method for mining the subsea floor comprising:

generating a first slurry by removing a surface layer of the subsea floor and mixing it with water;

flowing the first slurry into a separator;

flowing a portion of the first slurry through a fine particle screen to form a second slurry;

flowing the second slurry to be discharged into the ocean proximate to the subsea floor; and collecting particles from the first slurry, that do not pass through the fine particle screen, at the bottom of the separator and allowing them to enter a stream of water from the surrounding environment to create a third slurry that is passed to a subsea pipe for pumping to the surface;

electrocoagulating the second slurry and discharging of the electrocoagulated slurry to the surrounding environment.

* * * * *